US011219239B2

(12) United States Patent
Besso et al.

(10) Patent No.: US 11,219,239 B2
(45) Date of Patent: Jan. 11, 2022

(54) HYDROPHOBIC TIPPING PAPER

(71) Applicant: PHILIP MORRIS PRODUCTS S.A., Neuchâtel (CH)

(72) Inventors: Clément Besso, Neuchâtel (CH); Aurélien Guyard, Orbe (CH); Alen Kadiric, Orpund (CH)

(73) Assignee: Philip Morris Products S.A., Neuchâtel (CH)

( * ) Notice: Subject to any disclaimer, the term of this patent is extended or adjusted under 35 U.S.C. 154(b) by 662 days.

(21) Appl. No.: 15/511,687

(22) PCT Filed: Oct. 15, 2015

(86) PCT No.: PCT/IB2015/057946

§ 371 (c)(1),
(2) Date: Mar. 16, 2017

(87) PCT Pub. No.: WO2016/063182

PCT Pub. Date: Apr. 28, 2016

(65) Prior Publication Data

US 2017/0280766 A1 Oct. 5, 2017

Related U.S. Application Data

(60) Provisional application No. 62/066,065, filed on Oct. 20, 2014.

(51) Int. Cl.

| | |
|---|---|
| ***A24D 1/02*** | (2006.01) |
| ***D21H 19/10*** | (2006.01) |
| ***D21H 23/52*** | (2006.01) |
| ***A24D 1/20*** | (2020.01) |
| ***A24D 1/22*** | (2020.01) |

(52) U.S. Cl.
CPC ..... *A24D 1/02* (2013.01); *D21H 19/10* (2013.01); *D21H 23/52* (2013.01); *A24D 1/20* (2020.01); *A24D 1/22* (2020.01)

(58) Field of Classification Search
None
See application file for complete search history.

(56) References Cited

U.S. PATENT DOCUMENTS 2,033,791 A 3/1936 Sulzberger
3,534,743 A 10/1970 Monte et al.
(Continued)

FOREIGN PATENT DOCUMENTS

GB 985028 3/1965
GB 1 261 400 1/1972
(Continued)

OTHER PUBLICATIONS

First Examination Report issued by the European Patent Office for EP 15791759.2 dated Jul. 24, 2018; 7 pgs.
(Continued)

*Primary Examiner* — Phu H Nguyen
(74) *Attorney, Agent, or Firm* — Mueting Raasch Group

(57) ABSTRACT

A smoking article includes a tobacco substrate and a mouthpiece axially aligned in an abutting end to end relationship with the tobacco substrate. Hydrophobic tipping paper is disposed about the mouthpiece. The tipping paper is hydrophobic due to hydrophobic groups covalently bonded to the tipping paper.

14 Claims, 1 Drawing Sheet

(56) References Cited

U.S. PATENT DOCUMENTS

| | | | | |
|---|---|---|---|---|
| 3,924,643 | A * | 12/1975 | Summers | A24D 1/027 131/336 |
| 4,107,426 | A * | 8/1978 | Gordon | A61F 13/00991 229/5.85 |
| 4,340,074 | A | 7/1982 | Tudor | |
| 4,341,228 | A | 7/1982 | Keritsis et al. | |
| 5,584,306 | A | 12/1996 | Beauman et al. | |
| 5,595,196 | A | 1/1997 | Salonen et al. | |
| 5,724,998 | A | 3/1998 | Gellatly et al. | |
| 5,893,372 | A * | 4/1999 | Hampl, Jr. | A24D 1/02 131/280 |
| 6,064,032 | A * | 5/2000 | Voss | A24C 5/007 131/281 |
| 6,216,706 | B1 | 4/2001 | Kumar et al. | |
| 6,342,268 | B1 | 1/2002 | Samain | |
| 2003/0131860 | A1* | 7/2003 | Ashcraft | A24D 1/025 131/365 |
| 2004/0134631 | A1* | 7/2004 | Crooks | A24D 1/025 162/139 |
| 2012/0325232 | A1 | 12/2012 | Yokogawa et al. | |
| 2013/0236647 | A1 | 9/2013 | Samain et al. | |
| 2013/0345415 | A1 | 12/2013 | Trigiante | |

FOREIGN PATENT DOCUMENTS

| | | |
|---|---|---|
| GB | 1 483 495 | 8/1997 |
| WO | WO 2011/114530 A1 | 9/2011 |
| WO | WO 2014/017709 A1 | 1/2014 |

OTHER PUBLICATIONS

International Search Report and Written Opinion for PCT/IB2015/057946, issued by the European Patent Office, dated Jan. 25, 2016; 9 pgs.

Guo et al., "Synthesis and characterization of hydrophobic long-chain fatty acylated cellulose and its self-assembled nanoparticles," *Polym Bulletin,* Aug. 2012 69(4):389-103.

International Preliminary Report on Patentability for PCT/IB2015/057946, issued by the International Bureau of WIPO, dated May 4, 2017; 6 pgs.

* cited by examiner

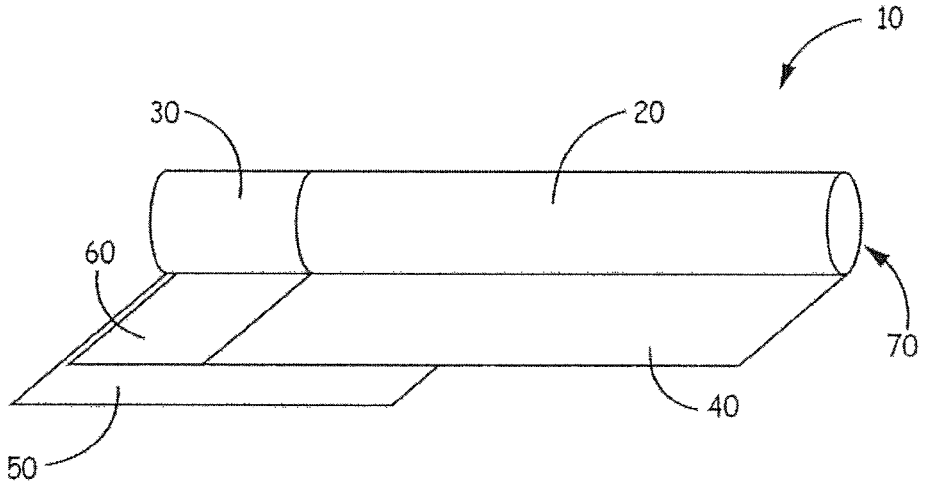
10
30
20
60
70
40
50

HYDROPHOBIC TIPPING PAPER

This application is the § 371 U.S. National Stage of International Application No. PCT/IB2015/057946, filed 15 Oct. 2015, which claims the benefit of U.S. Provisional Application No. 62/066,065, filed 20 Oct. 2014, the disclosures of which are incorporated by reference herein in their entireties.

The present disclosure relates to materials to make tipping paper in smoking articles.

Combustible smoking articles, such as cigarettes, typically comprise a cylindrical rod of tobacco cut filler surrounded by a wrapper and a cylindrical filter axially aligned in an abutting end-to-end relationship with the wrapped tobacco rod. The cylindrical filter typically comprises a filtration material circumscribed by a plug wrap. The wrapped tobacco rod and the filter are joined by a band of tipping wrapper, normally formed of a paper material that circumscribes the entire length of the filter and an adjacent portion of the wrapped tobacco rod. A cigarette is employed by a consumer by lighting one end thereof and burning the shredded tobacco rod. The smoker then receives mainstream smoke into their mouth by drawing on the mouth end or filter end of the cigarette.

Some smoking articles comprises an aerosol generating substrate containing tobacco which is heated rather than combusted when it is consumed. Known heated smoking articles include, for example, smoking articles in which an aerosol is generated by electrical heating or by the transfer of heat from a combustible fuel element or a heat source to an aerosol generating substrate. During smoking, volatile compounds are released from the aerosol generating substrate by heat transfer from the heat source and entrained in air drawn through the smoking article. As the released compounds cool they condense to form an aerosol that is inhaled by the consumer. Also known are smoking articles in which a nicotine-containing aerosol is generated from a tobacco-containing material or other nicotine source, without combustion or heating, for example through a chemical reaction.

These smoking articles include a mouthpiece portion that contacts the mouth or lips of the consumer. Tipping paper circumscribes the mouthpiece and forms the external surface of the mouthpiece that contacts the mouth or lips of the consumer. Typically the consumer's mouth or lips stick or adhere to the tipping paper during consumption.

Tipping paper made generally of plain paper absorbs liquid flavourant, humectant, water or any humidity or moisture surrounding the paper. The absorbed liquid stains or weakens the tipping paper and negatively affects the appearance and structural integrity of the smoking article. Heated smoking articles or aerosol-generating articles are particularly susceptible to wetting and breakage due to the high levels of humectant in the tobacco substrate of these heated smoking articles or aerosol-generating articles.

It would be desirable to provide a mechanically stable smoking article that does not stick to the mouth or lips of the consumer during consumption of the smoking article. It would be desirable to provide a smoking article that included tipping paper that did not readily absorb moisture from the consumer's mouth or lips or compounds found in the mainstream smoke or aerosol passing through the smoking article. It would also be desirable that this hydrophobic tipping paper does not affect the taste of the smoke or aerosol generated by the smoking article.

According to a first aspect, a smoking article includes a tobacco substrate and a mouthpiece axially aligned in an abutting end to end relationship with the tobacco substrate. Tipping paper is disposed about the mouthpiece. The tipping paper is hydrophobic due to hydrophobic groups covalently bonded to the tipping paper.

In another aspect, the hydrophobic tipping paper is produced by a process comprising the steps of: applying a liquid composition comprising a fatty acid halide to at least one surface of a tipping paper, and maintaining the surface at a temperature of about 120° C. to about 180° C. The fatty acid halide reacts in situ with protogenic groups of material in the tipping paper resulting in the formation of fatty acid esters.

In a further aspect, method of forming a smoking article includes reacting a fatty acid chloride with cellulosic material of the tipping paper to form a hydrophobic tipping paper.

In another aspect, a method for making hydrophobic tipping paper comprises the steps of: applying a liquid composition comprising a fatty acid halide to at least one surface of a tipping paper, and maintaining the surface at a temperature of about 120° C. to about 180° C. The fatty acid halide reacts in situ with protogenic groups of material in the tipping paper resulting in the formation of fatty acid esters.

Smoking articles that include a hydrophobic tipping paper can reduce wetting and eliminates or mitigates sticking of the mouthpiece to the consumer's mouth or lips. As a result, visible staining and physically weakening of the tipping paper portion of the smoking article may be reduced.

Smoking articles in accordance with the present disclosure may be filter cigarettes or other smoking articles in which tobacco material is combusted to form smoke. For example, the aerosol-generating substrate may comprise a tobacco rod and the mouthpiece may comprise a filter. The paper wrapper may comprise a tipping wrapper joining the filter to the tobacco substrate or rod. The term "smoking article" is used herein to indicate cigarettes, cigars, cigarillos and other articles in which a smokable material, such as a tobacco, is lit and combusted to produce smoke. The term "smoking article" also includes an aerosol-generating article in which an aerosol comprising nicotine is generated by heat without combusting the aerosol-forming substrate, such as tobacco substrate.

Alternatively, smoking articles according to the present disclosure may be articles in which an aerosol-generating substance, such as tobacco, is heated to form an aerosol rather than combusted. In one type of heated smoking article, an aerosol generating substance is heated by one or more electrical heating elements to produce an aerosol. In another type of heated smoking article, an aerosol is produced by the transfer of heat from a combustible or chemical heat source to a physically separate aerosol generating substrate, which may be located within, around or downstream of the heat source. The present disclosure further encompasses smoking articles in which a nicotine-containing aerosol is generated from a tobacco material, tobacco extract, or other nicotine source, without combustion, and in some cases without heating, for example through a chemical reaction.

The term "aerosol-generating article" is used herein to refer to heated smoking articles or smoking articles that are not cigarettes, cigars, cigarillos, or that combust a tobacco substrate to produce smoke. Smoking articles according to the invention may be whole, assembled smoking devices or components of smoking devices that are combined with one or more other components in order to provide an assembled device for producing an aerosol, such as for example, the consumable part of a heated smoking device or aerosol-generating article.

Typically, an aerosol-generating device comprises: a heat source; an aerosol-forming substrate (such as a tobacco substrate); at least one air inlet downstream of the aerosol-forming substrate; and an airflow pathway extending between the at least one air inlet and the mouth-end of the article. The heat source is preferably upstream from the aerosol-forming substrate. In many embodiments the heat source is integral with the aerosol-generating device and a consumable aerosol-generating article is releasably received within the aerosol-generating device.

The heat source may be a combustible heat source, a chemical heat source, an electrical heat source, a heat sink or any combination thereof. The heat source may be an electrical heat source, preferably shaped in the form of a blade that can be inserted into the aerosol-forming substrate. Alternatively, the heat source may be configured to surround the aerosol-forming substrate, and as such may be in the form of a hollow cylinder, or any other such suitable form. Alternatively, the heat source is a combustible heat source. As used herein, a combustible heat source is a heat source that is itself combusted to generate heat during use, which unlike a cigarette, cigar or cigarillo, does not involve combusting the tobacco substrate in the smoking article. Preferably, such a combustible heat source comprises carbon and an ignition aid, such as a metal peroxide, superoxide, or nitrate, wherein the metal is an alkali metal or alkaline earth metal.

The terms "upstream" and "downstream" refer to relative positions of elements of the smoking article described in relation to the direction of mainstream smoke or aerosol as it is drawn from a tobacco substrate or aerosol-generating substrate and through the and mouthpiece.

The term "mainstream smoke" is used herein to indicate smoke produced by combustible smoking articles, such as cigarettes, and aerosols produced by non-combustible smoking articles as described above. Mainstream smoke flows through the smoking article and is consumed by the user.

The term "mouthpiece" is used herein to indicate the portion of the smoking article that is designed to be contacted with the mouth of the consumer. The mouthpiece can be the portion of the smoking article that can includes a filter, or in some cases the mouthpiece can be defined by the extent of the tipping paper. In other cases, the mouthpiece can be defined as a portion of the smoking article extending about 40 mm from the mouth end of the smoking article, or extending about 30 mm from the mouth end of the smoking article.

The mouthpiece of smoking articles in accordance with the present invention may comprise a filter including one or more filter segments of filtration material. For example, the mouthpiece may comprise a single segment of filtration material, or the mouthpiece may comprise a multi-segment filter including two or more segments of filtration material. Where two or more filter segments are provided, the filter segments may be of the same construction and materials as each other. Preferably, however, the filter segments have a different construction, and/or contain different filtration material to each other.

The term "tipping paper" or "tipping wrapper" are interchangeable and refer to a wrapping material that is formed of paper or other material and optional filler materials. Tipping paper or tipping wrapper is disposed about at least a portion of the smoking article mouthpiece that comes into contact with the consumer's mouth or lips during consumption of the smoking article. Tipping paper or tipping wrapper joins the mouthpiece to the tobacco substrate or aerosol generating substrate. Tipping paper defines a wrap which circumscribes the mouthpiece and a portion of the tobacco substrate and joins the tobacco substrate to the mouthpiece. Where the mouthpiece is formed of a single segment, such as a single segment of filtration material, plug wrap will circumscribe the single segment and will generally be the only material between the underlying segment and the tipping paper or wrapper. The tipping paper is hydrophobic.

The term "hydrophobic" refers to a surface exhibiting water repelling properties. One useful way to determine this is to measure the water contact angle. The "water contact angle" is the angle, conventionally measured through the liquid, where a liquid/vapour interface meets a solid surface. It quantifies the wettability of a solid surface by a liquid via the Young equation.

The present disclosure provides a hydrophobic tipping paper (that is, having only a hydrophobic inner surface or at least a hydrophobic inner surface, or having only a hydrophobic outer surface or at least a hydrophobic outer surface, or having both a hydrophobic inner surface and a hydrophobic outer surface) disposed about or surrounding the mouthpiece.

It is contemplated that the hydrophobic tipping paper can reduce and prevent the mouth or lips of a consumer from sticking to the smoking article mouthpiece and reduce or prevent formation of spots on a smoking article that are visible to a consumer. It has been observed that spots can appear on a smoking article upon storage in a humid environment. The spots can be caused by absorption of water or humectant, including any coloured substances that are suspended or dissolved, into the web of cellulosic fibers that constitutes the tipping paper. Without being bound by any theory, the water or humectant interacts with the cellulosic fibers of the paper and alters the organization of the fibers resulting in a local change in the optical properties, such as brightness, color, and opacity, and mechanical properties, such as tensile strength, permeability of the tipping paper.

The tipping paper is the portion of the smoking article that is disposed about the mouthpiece and joining the mouthpiece to the tobacco substrate. This paper can exhibit a range of permeability or not be permeable. Permeability of cigarette paper is determined by utilizing the International Standard test method ISO 2965:2009 and the result is presented as cubic centimetres per minute per square centimetre and referred to as "CORESTA units".

In many embodiments, the permeability of the untreated wrapper (that is, with no hydrophobic treatment) can be in a range from 0 to 10,000 CORESTA units, or in a range from about 0 to 1,000 CORESTA units, or in a range from 0 to 100 CORESTA units, or in a range from about 0 to 10 CORESTA units, or in a range from 10 to 50 CORESTA units. In situ formation of the fatty acid esters (that is, hydrophobic treatment) with the tipping paper material reduces the permeability of the tipping paper by less than about 20%, or less than about 15%, or less than about 10% as compared to the permeability of the untreated wrapper described above.

Tipping paper can include ventilation elements such as a plurality of perforations. Perforations can be formed in the tipping paper at any stage of the manufacture process of the smoking article. The perforations can define one or more rows of voids or holes that circumscribe the smoking article. Preferable the perforations are placed at least 10 mm from the mouth end of the smoking article.

In various embodiments, the tipping paper can be formed of any suitable hydrophobic material. In many embodiments the tipping paper is formed of a material with pendent proteogenic groups. The term "protogenic" refers to a group that is able to donate a hydrogen or a proton in a chemical reaction. Preferably, the protogenic groups are reactive hydrophilic groups such as but not limited to a hydroxyl group (—OH), an amine group (—$NH_2$), or a sulfhydryl group (—$SH_2$). The invention will now be described, by way of example, with reference to wrappers comprising hydroxyl groups. Material with pendent hydroxyl groups includes cellulosic material such as paper, wood, textile, natural as well as artificial fibers. The tipping paper can also include one or more filler materials, for example calcium carbonate.

A tipping paper described herein, including any hydrophobic treatments, can have any suitable basis weight. The basis weight of a tipping paper can be in a range from about 10 to about 100 grams per square meter, from about 20 to about 100 grams per square meter, from about 30 to about 90 grams per square meter; or from about 30 to about 50 grams per square meter. A tipping paper can have any suitable thickness. The thickness of a tipping paper can be in a range from about 20 to about 120 micrometres or from about 30 to about 100 micrometres, or from about 40 to 60 micrometres. In preferred embodiments, a single filter wrapper is provided and this single filter wrapper has a basis weight as set out above. Alternatively, in some embodiments, multiple tipping wrappers may be provided, and the combined basis weight of the multiple wrappers may be the basis weight as set out above.

In many embodiments, the thickness of the tipping paper allows the hydrophobic groups or reagent applied to one surface to spread onto the opposing surface effectively providing similar hydrophobic properties to both opposing surfaces. In one example, the thickness of the tipping paper was about 43 micrometres and both surfaces were rendered hydrophobic by the gravure (printing) process using stearoyl chloride as the hydrophobic reagent to one surface. Accordingly, although many of the benefits of the invention only requires that one of the two major surfaces, that is, either the inner surface or the outer surface, exhibits the hydrophobic properties, it is contemplated that paper which exhibits hydrophobic properties on both major surfaces can also be used similarly. Preferably, only or at least the outer surface is hydrophobic. Therefore, the invention encompasses various applications in which the tipping paper comprises at least one hydrophobic surface.

The hydrophobic surface of a tipping paper can also inhibit the transfer, absorption and accumulation of humectant, water and other dissolved or suspended substances to the tipping paper that can form visible spots on the tipping paper of smoking articles or weaken the tipping paper. Essentially, the hydrophobic surface reduces or prevents the staining of the tipping paper by water, humectant and other dissolved or suspended substances.

The hydrophobic tipping paper can also inhibit the transfer, absorption and accumulation of humectant, water and staining of the tipping paper that occurs when the smoking article is stored or utilized in a humid environment, particularly where the humidity is very high (e.g., relative humidity greater than 70%, 80%, 90%, 95%, 99%) or when the smoking article is stored for an extended period, (e.g., more than three weeks, two months, three months, or six months), or a combination of such conditions.

The hydrophobic nature of the tipping paper can also prevent or reduce the incidence of deformation or disintegration of the mouthpiece of a smoking article where moisture, or humectant interacts with the tipping paper. When humectant or water penetrates the tipping paper surface and is absorbed, the structure of the tipping paper is weakened, effectively lowering the tensile strength of the tipping paper and leading to easy tearing or collapse of the tipping paper or mouthpiece.

In addition hydrophobic nature of the tipping paper can also prevent or reduce the incidence of stickiness to a consumer's lips or mouth by reducing moisture from the consumer's lips and mouth from being absorbed or interacting with the tipping paper. "Stickiness" is a qualitative test that can be determined by a panel of testers based on whether the smoking article "sticks" or adheres to the tester's lips during use.

In some embodiments, the material or method to create the hydrophobic wrapper does not substantially affect the permeability of the tipping paper. Preferably, the reagent or method to create the hydrophobic tipping paper changes the permeability of the tipping paper (as compared to the untreated wrapper material) by less than about 10% or less than about 5%.

In various embodiments, the hydrophobic surface of the tipping paper has a Cobb water absorption (ISO535:1991) value (at 60 seconds) of less than about 30 $g/m^2$, less than about 20 $g/m^2$, less than about 15 $g/m^2$, or less than about 10 $g/m^2$.

In various embodiments, the hydrophobic surface of the tipping paper has a water contact angle of at least about 90 degrees, at least about 95 degrees, at least about 100 degrees, at least about 110 degrees, at least about 120 degrees, at least about 130 degrees at least about 140 degrees, at least about 150 degrees, at least about 160 degrees, or at least about 170 degrees. Hydrophobicity is determined by utilizing the TAPPI T558 om-97 test and the result is presented as an interfacial contact angle and reported in "degrees" and can range from near zero degrees to near 180 degrees. Where no contact angle is specified along with the term hydrophobic, the water contact angle is at least 90 degrees.

In preferred embodiments, the outer surface of the tipping paper has a water contact angle of at least about 90 degrees, at least about 95 degrees, at least about 100 degrees, at least about 110 degrees, at least about 120 degrees, at least about 130 degrees at least about 140 degrees, at least about 150 degrees, at least about 160 degrees, or at least about 170 degrees. The inner surface may be less hydrophobic than the outer surface. In other embodiments, the inner surface has a water contact angle that is substantially the same as the outer surface, or within about 20 degrees of the contact angle of the outer surface.

The hydrophobic surface can be uniformly present along the length of the tipping paper. In some configurations the hydrophobic surface is not uniformly present along the length of the tipping paper. For example, the hydrophobic surface may be preferentially present on a portion of the tipping paper adjacent to the mouth end of the smoking article and not present on an upstream portion of the tipping paper. In many embodiments, the hydrophobic surface is preferentially located at lip-contacting region of the tipping paper and not present upstream of this lip-contacting region. In one embodiment, the hydrophobic surface is located only within about 30 mm or within about 20 mm of the mouth end. In some embodiments the hydrophobic surface forms a pattern along all or a portion of the length of the tipping paper. Portions of the tipping paper this are not hydrophobic can include indicia that may not be easily applied to a hydrophobic surface.

In many embodiments the hydrophobic surface can be formed by printing reagent along the length of the tipping paper. Any useful printing methods can be utilized such as gravure, ink jet and the like. The reagent can include any useful hydrophobic groups that can be covalently bonded to the tipping paper material or pendent groups of the tipping paper material.

The hydrophobic surface can be formed with any suitable hydrophobic reagent or hydrophobic group. The hydrophobic reagent is preferably chemically bonded to the tipping paper or pendent protogenic groups of the tipping paper material. In many embodiments the hydrophobic reagent is covalently bonded to the tipping paper or pendent protogenic groups of the tipping paper material. For example, the hydrophobic group is covalently bonded to pendent hydroxyl groups of cellulosic material forming the tipping paper. A covalent bond between structural components of the tipping paper and the hydrophobic reagent can form hydrophobic groups that are more securely attached to the tipping paper material than simply disposing a coating of hydrophobic material on the tipping paper surface. By chemically bonding the hydrophobic reagent at the molecular level in situ rather than applying a layer of hydrophobic material in bulk to cover the surface allows the permeability of the tipping paper to be better maintained, since a coating tends to cover or block pores in the tipping paper and reduce the permeability. Chemically bonding hydrophobic groups to the tipping paper in situ can also reduce the amount of material required to render the surface of the tipping paper hydrophobic. The term "in situ" as used herein refers to the location of the chemical reaction which takes place on or near the surface of the solid material that forms the tipping paper, which is distinguishable from a reaction with cellulose dissolved in a solution. For example, the reaction takes place on or near the surface of paper which comprises cellulosic material in a heterogenous structure. However, the term "in situ" does not require that the chemical reaction takes place directly on a smoking article The hydrophobic reagent may comprises an acyl group or fatty acid group. The acyl group or fatty acid group or mixture thereof can be saturated or unsaturated. A fatty acid group (such as a fatty acid halide) in the reagent can react with pendent protogenic groups such as hydroxyl groups of the cellulosic material to form an ester bond covalently bonding the fatty acid to the cellulosic material. In essence, these reactions with the pendant hydroxyl groups can esterify the cellulosic material.

The acyl group or fatty acid group includes a $C_{12}$-$C_{30}$ alkyl (an alkyl group having from 12 to 30 carbon atoms), a $C_{14}$-$C_{24}$ alkyl (an alkyl group having from 14 to 24 carbon atoms) or preferably a $C_{16}$-$C_{20}$ alkyl (an alkyl group having from 16 to 20 carbon atoms). Those skill in the art would understand that the term "fatty acid" as used herein refers to long chain aliphatic, saturated or unsaturated fatty acid that comprises 12 to 30 carbon atoms, 14 to 24 carbon atoms, 16 to 20 carbon atoms or that has greater than 15, 16, 17, 18, 19, or 20 carbon atoms. In various embodiments, the hydrophobic reagent includes an acyl halide, a fatty acid halide, such as, a fatty acid chloride including palmitoyl chloride, stearoyl chloride or behenoyl chloride, a mixture thereof, for example. The in situ reaction between fatty acid chloride and cellulose in the wrapper results in fatty acid esters of cellulose and hydrochloric acid.

Any suitable method can be utilized to chemically bond the hydrophobic reagent or group to the tipping paper. As one example, an amount of hydrophobic reagent is deposited without solvent at the surface of paper at controlled temperature, for example, droplets of the reagents forming 20-micrometer regularly-spaced circles on the surface. The control of the vapour tension of the reagent can promote the propagation of the reaction by diffusion with the formation of ester bonds between fatty acid and cellulose while continuously withdrawing unreacted acid chloride. The esterification of cellulose is in some cases based on the reaction of alcohol groups or pendent hydroxyl groups of cellulose with an acyl halide, such as an acyl chloride including a fatty acid chloride. The temperature that can be used to heat the hydrophobic reagent depends on the chemical nature of the reagent and for fatty acid halides, it ranges from about 120° C. to about 180° C.

The hydrophobic reagent can be applied to the tipping paper in any useful amount or basis weight. In many embodiments the basis weight of the hydrophobic reagent is less than about 3 grams per square meter, less than about 2 grams per square meter, or less than about 1 gram per square meter or in a range from about 0.1 to about 3 grams per square meter, from about 0.1 to about 2 grams per square meter, or from about 0.1 to about 1 gram per square meter. The hydrophobic reagent can be applied or printed on the tipping paper surface and define a uniform or non-uniform pattern.

Preferably the hydrophobic tipping paper is formed by reacting a fatty acid ester group or a fatty acid group with pendent hydroxyl groups on the cellulosic material of the wrapper to form a hydrophobic surface of the tipping paper. The reacting step can be accomplished by applying a fatty acid halide (such as chloride, for example) which provides the fatty acid ester group or a fatty acid group to chemically bond with pendent hydroxyl groups on the cellulosic material of the tipping paper to form a hydrophobic surface of the wrapper. The applying step can be carried out by loading the fatty acid halide in liquid form onto a solid support, such as a brush, a roller, or an absorbent or non-absorbent pad, and then contacting the solid support with a surface of the wrapper. The fatty acid halide can also be applied by printing techniques, such as gravure, flexography, ink jet, heliography, by spraying, by wetting, or by immersion in a liquid comprising the fatty acid halide. The applying step can deposit discrete islands of reagent forming a uniform or non-uniform pattern of hydrophobic areas on the surface of the tipping paper. The uniform or non-uniform pattern of hydrophobic areas on the wrapper can be formed of at least about 100 discrete hydrophobic islands, at least about 500 discrete hydrophobic islands, at least about 1000 discrete hydrophobic islands, or at least about 5000 discrete hydrophobic islands. The discrete hydrophobic islands can have any useful shape such as a circle, rectangle or polygon. The discrete hydrophobic islands can have any useful average lateral dimension. In many embodiments the discrete hydrophobic islands have an average lateral dimension in a range from 5 to 100 micrometres, or in a range from 5 to 50 micrometres. To aid diffusion of the applied reagent on the surface, a gas stream can also be applied. Apparatus and processes such as those described in US patent publication 20130236647, incorporated herein by reference in its entirety can be used to produce the hydrophobic tipping paper.

According to the invention, a hydrophobic tipping paper can be produced by a process comprising applying a liquid composition comprising a aliphatic acid halide to at least one surface of a tipping paper, optionally applying a gas stream to the surface to aid diffusion of the applied fatty acid halide, and maintaining the surface at a temperature about 120° C. to about 180° C., wherein the fatty acid halide reacts in situ with the hydroxyl groups of the cellulosic material in the tipping paper resulting in the formation of aliphatic acid esters. Preferably, the tipping paper is made of paper, and the fatty acid halide is stearoyl chloride, palmitoyl chloride, or a mixture of fatty acid chlorides with 16 to 20 carbon atoms in the acyl group. The hydrophobic tipping paper produced by a process described hereinabove is thus distinguishable from material made by coating the surface with a layer of pre-made fatty acid ester of cellulose.

The hydrophobic tipping paper is produced by a process of applying the liquid reagent composition to the at least one surface of a tipping paper at a rate of in a range from about 0.1 to about 3 grams per square meter, or from about 0.1 to about 2 grams per square meter, or from about 0.1 to about 1 gram per square meter. The liquid reagent applied at these rates renders the surface of a tipping paper hydrophobic.

Smoking articles, such as cigarettes and aerosol generating articles, include a tobacco substrate or an aerosol generating substrate that comprises a charge of tobacco circumscribed by a wrapper. The tobacco substrate may comprise any suitable type or types of tobacco material or tobacco substitute, in any suitable form. Preferably, the tobacco rod includes flue-cured tobacco, Burley tobacco, Maryland tobacco, Oriental tobacco, specialty tobacco, or any combination thereof. Preferably, the tobacco is provided in the form of tobacco cut filler, tobacco lamina, processed tobacco materials, such as volume expanded or puffed tobacco, processed tobacco stems, such as cut-rolled or cut-puffed stems, homogenized tobacco, reconstituted tobacco, cast leaf tobacco, or blends thereof, and the like. The term "tobacco cut filler" is used herein to indicate tobacco material that is predominately formed from the lamina portion of the tobacco leaf. The terms "tobacco cut filler" is used herein to indicate both a single species of *Nicotiana* and two or more species of *Nicotiana* forming a tobacco cut filler blend.

As used herein, the term "homogenized tobacco" denotes a rod or a sheet of material formed by agglomerating particulate tobacco by-products, such as tobacco fines, tobacco dusts, tobacco stems, or a mixture of the foregoing, and may include reconstituted tobacco, cast leaf tobacco, or both. The term "reconstituted tobacco" refers to a paper-like material that can be made from tobacco by-products by extracting the soluble chemicals in the tobacco by-products, processing the leftover tobacco fibers from the extraction into a paper-like sheet, and then reapplying the extracted materials in concentrated form onto the sheet. The term "cast leaf tobacco" refers to a paper-like material made by casting a slurry comprising particulate tobacco by-products and a binder (for example, guar) onto a supportive surface, such as a belt conveyor, drying the slurry and removing the dried sheet from the supportive surface. Exemplary methods for producing various types of homogenized tobacco are described in U.S. Pat. Nos. 5,724,998; 5,584,306; 4,341,228; 5,584,306 and 6,216,706.

The tobacco substrate or aerosol-generating substrate can include a high level of humectant material. Humectant material can be referred to as an "aerosol former". An aerosol former is used to describe any suitable known compound or mixture of compounds that, in use, facilitates formation of an aerosol and that is substantially resistant to thermal degradation at the operating temperature of the tobacco substrate or aerosol-generating substrate.

Suitable humectants or aerosol-formers are known in the art and include, but are not limited to: polyhydric alcohols, such as propylene glycol, triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate. Preferred humectants or aerosol formers are polyhydric alcohols or mixtures thereof, such as propylene glycol, triethylene glycol, 1,3-butanediol and, most preferred, glycerine. The tobacco substrate or aerosol-forming substrate may comprise a single humectant or aerosol former. Alternatively, the tobacco substrate or aerosol-generating substrate may comprise a combination of two or more humectants or aerosol formers.

In many embodiments, the tobacco substrate or aerosol-generating substrate has a humectant or aerosol former content of greater than about 10% or preferably greater than about 15% or more preferably greater than about 20%, on a dry weight basis. The tobacco substrate or aerosol-forming substrate has a humectant or aerosol former content of between about 10% and about 30%, or preferably from about 15% and about 30%, or more preferably from about 20% and about 30%, on a dry weight basis.

The mouthpiece of smoking articles in accordance with the present invention may comprise a filter including one or more filter segments of filtration material. For example, the mouthpiece may comprise a single segment of filtration material, or the mouthpiece may comprise a multi-segment filter including two or more segments of filtration material. Where two or more filter segments are provided, the filter segments may be of the same construction and materials as each other. Preferably, however, the filter segments have a different construction, and/or contain different filtration material to each other. In any of the embodiments in which the mouthpiece comprises one or more segments of filtration material, at least one of the filter segments may include a flavourant material.

The flavourant may be provided directly onto a component of a filter. Alternatively, the flavourant may be provided as part of a flavourant delivery component that is configured to release the flavourant in response to a trigger mechanism. In some embodiments, the flavourant is a particulate flavourant material. Suitable particulate flavourant materials include particles of a sorbent or cellulosic material impregnated with a liquid flavourant.

The term "liquid release component" is used herein to refer to a discrete piece or portion of a liquid delivery material which is in a form that is suitable to be incorporated into a smoking article or aerosol-generating article. The liquid release component releases a liquid comprising a functional material. The liquid release component is preferably in the form of a bead, a capsule or a microcapsule. In preferred embodiments, the liquid release component is a flavourant delivery component for providing flavour in a smoking article. As used herein, the term "liquid" refers to compositions that are in a liquid state at room temperature, for example, 22° C.

In some embodiments, the flavourant is provided in a capsule which is adapted to release at least a portion of a liquid when the capsule is subjected to external force, such as squeezing, by the consumer. Thus, rupturing the capsule releases an amount of liquid flavourant into the filter segment or filtration material. The capsule can comprise an outer shell and an inner core containing the flavourant. Preferably, the outer shell is sealed before the application of an external force, but is frangible or breakable to allow the flavourant to be released when the external force is applied. The capsule may be formed in a variety of physical formations including, but not limited to, a single-part capsule, a multi-part capsule, a single-walled capsule, a multi-walled capsule, a large capsule, and a small capsule. Alternatively, the liquid flavourant is contained in a liquid releasing component which comprises a matrix structure defining a plurality of domains enclosing the liquid flavourant and which provides a sustained-release delivery profile, such that the amount of the flavour composition released upon compression of the flavour release component can be controlled through the adjustment of the compressive force applied by the consumer. Those of skill in the art will understand that the term "sustained release" covers those embodiments in which the amount of flavourant released at a given force depends additionally on the duration of the applied force.

In many embodiments the overall length of the smoking article is between about 70 mm and about 130 mm or is between about 30 mm and about 100 mm. In some embodiments the overall length of the smoking article is about 85 mm or about 45 mm. The external diameter of smoking article can be between about 5.0 mm and about 12 mm, or between about 5.0 mm and about 8 mm, or 7.2 mm±10%. The overall length of the filter of the smoking article can be between about 18 mm and about 36 mm. In some embodiments the overall length of the filter is about 27 mm.

Where the mouthpiece includes one or more segments of filtration material, the filtration material is preferably a plug of fibrous filtration material, such as cellulose acetate tow or paper. A filter plasticiser may be applied to the fibrous filtration material in a conventional manner, by spraying it onto the separated fibres, preferably before applying any particulate material to the filtration material. The mouthpiece may include a variety of different types of filter segments or combinations of filter segments, including those described above as well as other types of filter segments that would be known to the skilled person, such as segments including restrictors and segments that are used for adjusting the resistance to draw (RTD).

The resistance to draw (RTD) of the smoking articles and the filters of the present disclosure can vary. In many embodiments the RTD of the smoking article is between about 50 to 130 mm $H_2O$. The RTD of a smoking article refers to the static pressure difference between the two ends of the specimen when it is traversed by an air flow under steady conditions in which the volumetric flow is 17.5 millilitres per second at the output end. The RTD of a specimen can be measured using the method set out in ISO Standard 6565:2002 with any ventilation (if present) blocked.

In one or more embodiments, smoking articles according to the present disclosure may be packaged in containers, for example in soft packs or hinge-lid packs, with an inner liner coated with one or more flavourants.

All scientific and technical terms used herein have meanings commonly used in the art unless otherwise specified. The definitions provided herein are to facilitate understanding of certain terms used frequently herein.

The term "tobacco substrate" or "aerosol-generating substrate" includes a rod of tobacco formed of shredded tobacco or tobacco cut filler, or it may include reconstituted tobacco or cast leaf tobacco, or a mixture of both. The tobacco substrate can be connected to the mouthpiece or filter in an end-to-end relationship, as further discussed below.

The term "tobacco cut filler" is used herein to indicate tobacco material that is predominately formed from the lamina portion of the tobacco leaf. The terms "tobacco cut filler" is used herein to indicate both a single species of *Nicotiana* and two or more species of *Nicotiana* forming a tobacco cut filler blend.

As used in this specification and the appended claims, the singular forms "a", "an", and "the" encompass embodiments having plural referents, unless the content clearly dictates otherwise.

As used in this specification and the appended claims, the term "or" is generally employed in its sense including "and/or" unless the content clearly dictates otherwise.

As used herein, "have", "having", "include", "including", "comprise", "comprising" or the like are used in their open ended sense, and generally mean "including, but not limited to". It will be understood that "consisting essentially of", "consisting of", and the like are subsumed in "comprising," and the like.

The words "preferred" and "preferably" refer to embodiments of the invention that may afford certain benefits under certain circumstances. However, other embodiments may also be preferred under the same or other circumstances. Furthermore, the recitation of one or more preferred embodiments does not imply that other embodiments are not useful, and is not intended to exclude other embodiments from the scope of the disclosure, including the claims.

FIG. 1 is a schematic perspective view of an embodiment of a partially unrolled smoking article.

The smoking articles depicted in FIG. 1 illustrate one or more embodiments of smoking articles or components of smoking articles described above. The schematic drawings are not necessarily to scale and are presented for purposes of illustration and not limitation. The drawings depict one or more aspects described in this disclosure. However, it will be understood that other aspects not depicted in the drawings fall within the scope and spirit of this disclosure.

Referring now to FIG. 1, a smoking article 10 is depicted. The smoking article 10 includes a tobacco substrate 20, such as a tobacco rod, and a mouth end segment 30 and a lit end tip 70. The mouthpiece 30 can abut the tobacco substrate 20 in the finished smoking article 10. The depicted smoking article 10, includes a plug wrap 60 that circumscribes at least a portion of the filter or mouthpiece segment 30 and a wrapper 40 that circumscribes at least a portion of the tobacco substrate 20. Hydrophobic tipping paper 50 circumscribes the plug wrap 60 and a portion of the wrapper 40.

The exemplary embodiments described above are not limiting. Other embodiments consistent with the exemplary embodiments described above will be apparent to those skilled in the art.

The invention claimed is:

1. A smoking article comprising:

a tobacco substrate;

a mouthpiece axially aligned in an abutting end to end relationship with the tobacco substrate; and tipping paper disposed about the mouthpiece, wherein the tipping paper is hydrophobic due to hydrophobic groups covalently bonded to the tipping paper, and wherein the tipping paper is made hydrophobic by depositing at least 100 discrete islands of hydrophobic reagent onto a surface of the tipping paper.

2. A smoking article according to claim 1, wherein the tipping paper has a water contact angle of at least about 100 degrees.

3. A smoking article according to claim 1, wherein the tipping paper comprises cellulosic material and a hydrophobic group is covalently bonded to the cellulosic material.

4. A smoking article according to claim 3, wherein the hydrophobic group is a fatty acid ester.

5. A smoking article according to claim 1, wherein the tipping paper has a basis weight in a range from about 30 to about 90 grams per square meter and the hydrophobic group has a basis weight in a range from about 0.1 to about 3 grams per square meter.

6. A smoking article according to claim 1, wherein the hydrophobic group is covalently bonded to cellulosic material of the tipping paper by reacting in situ a fatty acid chloride with the cellulosic material.

7. A smoking article according to claim 6, wherein the fatty acid chloride is palmitoyl chloride, stearoyl chloride, behenoyl chloride, or a mixture of palmitoyl chloride and stearoyl chloride.

8. A smoking article according to claim 1, wherein the hydrophobic tipping paper comprises fatty acid esters of cellulose.

9. A smoking article according to claim 1, wherein the tipping paper exhibits a Cobb measurement value (60 s) of less than 20 $g/m^2$.

10. A smoking article according to claim 1, wherein the hydrophobic tipping paper is produced by a process comprising the steps of: applying a liquid composition comprising a fatty acid halide to at least one surface of a tipping paper, maintaining the surface at a temperature of about 120° C. to about 180° C., wherein the fatty acid halide reacts in situ with protogenic groups of material in the tipping paper resulting in the formation of fatty acid esters.

11. A smoking article according to claim 10, wherein the process comprises applying a liquid composition comprising stearoyl chloride or palmitoyl chloride to at least one surface of a tipping paper at a temperature of about 120° C. to about 180° C., wherein hydroxyl groups in the cellulosic material of the tipping paper reacts in situ with the stearoyl chloride or palmitoyl chloride.

12. A smoking article according to claim 10, wherein the process comprises applying the liquid composition to the at least one surface of a tipping paper at a rate of in a range from about 0.1 to about 3 grams per square meter to render the at least one surface of the tipping paper hydrophobic.

13. A smoking article according to claim 1, wherein the tipping paper fixes the tobacco substrate to the mouthpiece.

14. A smoking article according to claim 1, wherein the hydrophobic tipping paper defines a uniform or non-uniform pattern of discrete hydrophobic areas on the tipping paper.

* * * * *